US007152747B2

(12) United States Patent
Wang

(10) Patent No.: US 7,152,747 B2
(45) Date of Patent: Dec. 26, 2006

(54) ANTITHEFT DISPLAY DEVICE FOR SOCKET

(76) Inventor: Yao-Hong Wang, No. 21,23 Lane, Jen-Ying St., Tai-Ping City, Taichung County (TW)

( * ) Notice: Subject to any disclaimer, the term of this patent is extended or adjusted under 35 U.S.C. 154(b) by 78 days.

(21) Appl. No.: 11/085,453

(22) Filed: Mar. 21, 2005

(65) Prior Publication Data

US 2006/0207951 A1 Sep. 21, 2006

(51) Int. Cl.
*A47F 7/00* (2006.01)

(52) U.S. Cl. ..... 211/70.6

(58) Field of Classification Search ..... 211/70.6, 211/4, 94.01, 183, 7; 206/372, 378
See application file for complete search history.

(56) References Cited

U.S. PATENT DOCUMENTS 5,467,874 A * 11/1995 Whitaker ..... 206/378
6,092,655 A * 7/2000 Ernst ..... 206/378
6,095,329 A * 8/2000 Kao ..... 206/378
6,386,363 B1 * 5/2002 Huang ..... 206/378
6,415,933 B1 * 7/2002 Kao ..... 211/70.6
6,431,373 B1 * 8/2002 Blick ..... 211/70.6
6,637,605 B1 * 10/2003 Ernst ..... 211/70.6
6,672,476 B1 * 1/2004 Cash et al. ..... 221/311
6,854,607 B1 * 2/2005 Tong ..... 211/70.6
7,066,339 B1 * 6/2006 Chiu et al. ..... 211/70.6
2003/0024837 A1 * 2/2003 Chen ..... 206/378
2004/0188366 A1 * 9/2004 Tong ..... 211/70.6
2005/0227841 A1 * 10/2005 Hwang ..... 483/59

* cited by examiner

*Primary Examiner*—Jennifer E. Novosad
(74) *Attorney, Agent, or Firm*—Charles E. Baxley

(57) ABSTRACT

The present invention relates to an antitheft display device for socket, wherein the socket can be locked on the display device in an antitheft manner through the cooperation of a housing, a retainer, an inserting member, an elastic member and a positioning member. Furthermore, the socket can be released or locked simply through insertion and withdrawal of the positioning member, this allows the user to release the socket from the display device, or to position the socket again on the display device and turn on the antitheft function after use.

20 Claims, 9 Drawing Sheets

ANTITHEFT DISPLAY DEVICE FOR SOCKET

BACKGROUND OF THE INVENTION

1. Field of the Invention

The present invention relates to a device for storage of socket, and more particularly to an antitheft display device for socket that can be used repeatedly.

2. Description of the Prior Arts

A conventional antitheft display device for socket, such as disclosed by U.S. Pat. No. 6,581,894, generally comprises a plug device and a hanger device, the housing of the plug device is inserted and locked in the cavity of the socket (the article), a plurality of projections are formed on the peripheral wall of the housing for engagement with the depressions of the socket. A partition formed between the housing and the casing of the plug device includes a slot and an orifice, on the casing are formed an opening, a slit and a notch which are connected to each other and arranged to form a substantially "Z" shaped structure, on the casing and close to the opening thereof is defined ramps.

The hanger device includes a board, a block and an actuator which are integrally formed together, the actuator is to be engaged through the slot and to be engaged into the chamber of the housing, the block of the hanger device is positioned in the casing of the plug device, and the anti-theft function can be activated by rotating the hanger device, so that the board may be moved over the ramps and then be stably received and retained in the notch of the casing, such that the board may be locked to the casing, and such that the hanger device may be locked to the plug device, and such that the article may be prevented from being disengaged and removed from the plug device and the hanger device.

However, in operation, the aforementioned antitheft socket-display device still has some problems, and the reasons are explained as follows:

Since the hanger device will be retained in the notch of the casing after the anti-theft function is activated, plus the ramps are inclined gradually outward starting from the notch, this makes it difficult for the hanger device to disengage from the limitation of the notch, so that the socket cannot be removed from the display device unless the notch of hanger device is damaged. In other words, the socket cannot be restored in the display device anymore after use, and the display device will lose its storage function, and the user has to find other box or container for storage of the socket. Therefore, this conventional display device for socket is unrecyclable.

The present invention has arisen to mitigate and/or obviate the afore-described disadvantages.

SUMMARY OF THE INVENTION

The primary objective of the present invention is to provide an antitheft display device for socket, wherein the socket can be locked on the display device in an antitheft manner through the cooperation of a housing, a retainer, an inserting member, an elastic member and a positioning member.

The secondary objective of the present invention is to provide an antitheft display device for socket, wherein the socket can be released or locked simply through insertion and withdrawal of the positioning member, this allows the user to release the socket from the display device, or to position the socket again on the display device and turn on the antitheft function after use. Therefore, the display device for socket in accordance with the present invention not only possesses antitheft function but also can be used repeatedly.

The present invention will become more obvious from the following description when taken in connection with the accompanying drawings, which show, for purpose of illustrations only, the preferred embodiments in accordance with the present invention.

BRIEF DESCRIPTION OF THE DRAWINGS

FIG. 3 is a cross sectional view of showing the antitheft display device for socket of the first preferred embodiment, wherein the antitheft function has not been turned on;

FIG. 4 s a cross sectional view of showing the antitheft display device for socket of the first preferred embodiment, wherein the antitheft function has been turned on;

DETAILED DESCRIPTION OF THE PREFERRED EMBODIMENTS

Figure 1:
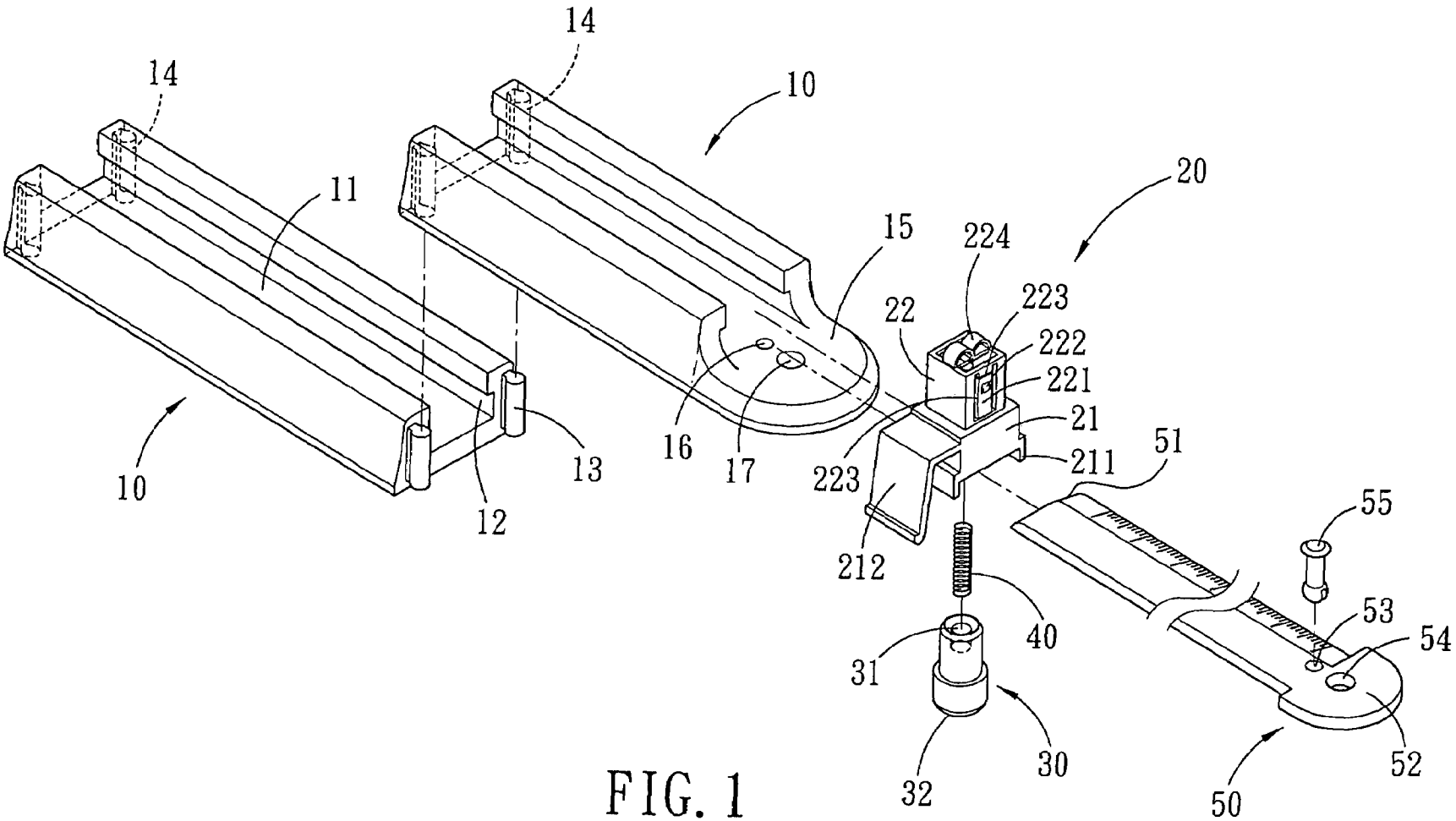
FIG. 1 is an exploded view of an antitheft display device for socket in accordance with a first preferred embodiment of the present invention.

Referring to FIG. 1, an antitheft display device for socket in accordance with a first preferred embodiment of the present invention is shown and comprises: a housing 10, a retainer 20, an inserting member 30, an elastic member 40 and a positioning member 50.

The housing 10 is axially provided with a sliding groove 11 which is ⊔-shaped in cross section and has two open end, at a lower portion of either side of the sliding groove 11 is defined a guiding groove 12. At an end of the housing 10 are provided two ribs 13 that include a circular base portion and a neck portion, and another end of the housing 10 are arranged with two cavities 14 formed correspondingly to the shape of the ribs 13, so that a plurality of housings 10 can be connected to one another through the engagement of the ribs 13 with the cavities 14. Furthermore, the housing 10 is integrally provided at one of its end with a board-like hanging portion 15, on which are formed a through hole 16 and a hanging hole 17.

The retainer 20 includes a base 21 integrally formed with a head 22, the base 21 is provided with two rails 211 formed correspondingly to the guiding grooves 12 of the housing 10, so that the retainer 20 can be slidably mounted on the housing 10. At a side of the base 21 is formed a bent portion 212 which straddles over the housing 10, while at a bottom of the base 21 is formed a recess 213 which is located beneath the top surface of the head 22. A projection 214 is formed at the bottom of the recess 213, and at either side of the head 22 is arranged an elastic bent locking portion 221 having an arc-shaped projection 222. At the lateral edge and the upper edge of the bent locking portion 221 is formed a slit 223 respectively, and at the top surface of the head 22 is formed an m-shaped retaining portion 224.

The inserting member 30 takes the form of rod having a stepped portion and are inserted in the recesses 213 of the retainer 20, at an end of the inserting member 30 is provided a cavity 31 formed correspondingly to the projection 214 of the retainer 20, and another end of the inserting member 30 is formed an arc-shaped pushing head 32.

The elastic member 40 (let's take spring as an example) is biased between the cavity 31 of the inserting member 30 and the projection 214 of the retainer 20.

The positioning member 50, an end of which is formed an arc-shaped surface 51 which is to be inserted between the sliding groove 11 of the housing 10 and the bottom of the base 21 of the retainer 20, another end of the positioning member 50 is provided with a handle portion 52 having a semi-circle shape formed correspondingly to the hanging portion 15 of the housing 10. The positioning member 50 is also provided with a hole 53 and a through hole 54 correspondingly to the through hole 16 and the hanging hole 17 of the housing 10, so that the positioning member 50 can be assembled with the housing 10 by inserting a locking pin 55 simultaneously through the hole 53 and the through hole 16. Furthermore, the positioning member 50 is provided on its surface with scales for measuring purpose.

Figure 2:
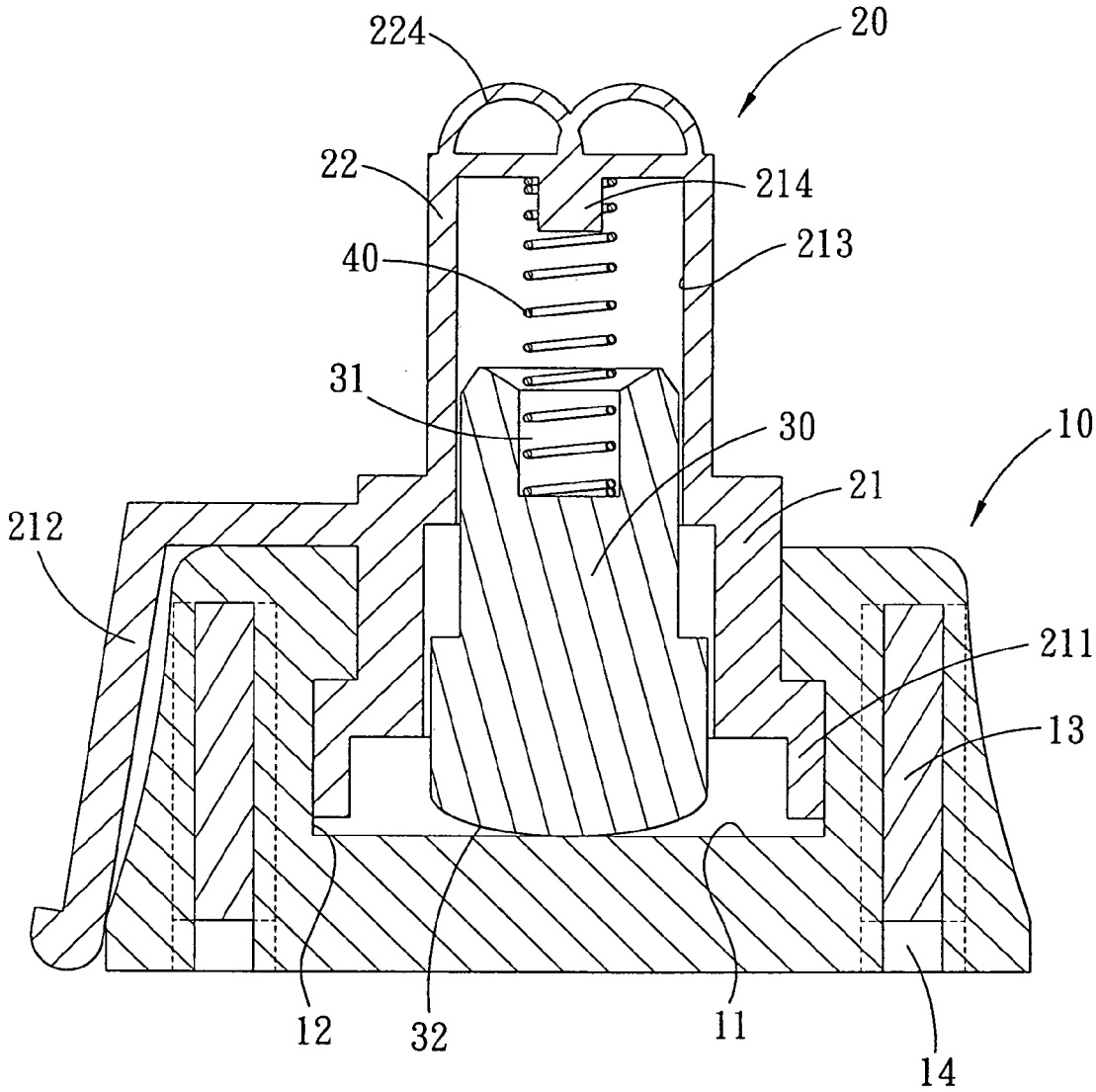
FIG. 2 is a cross sectional view of the antitheft display device for socket in accordance with the first preferred embodiment of the present invention.

For a better understanding of the embodiment of the present invention and its operation and function, reference should be made to FIG. 2, the design of the guiding groove 12 of the housing 10 and the rail 211 of the retainer 20 enables the retainer 20 to be slidably mounted on the housing 10 under the control of the user, and the bent portion 212 of the retainer covers a side of the housing 10.

Figure 3:
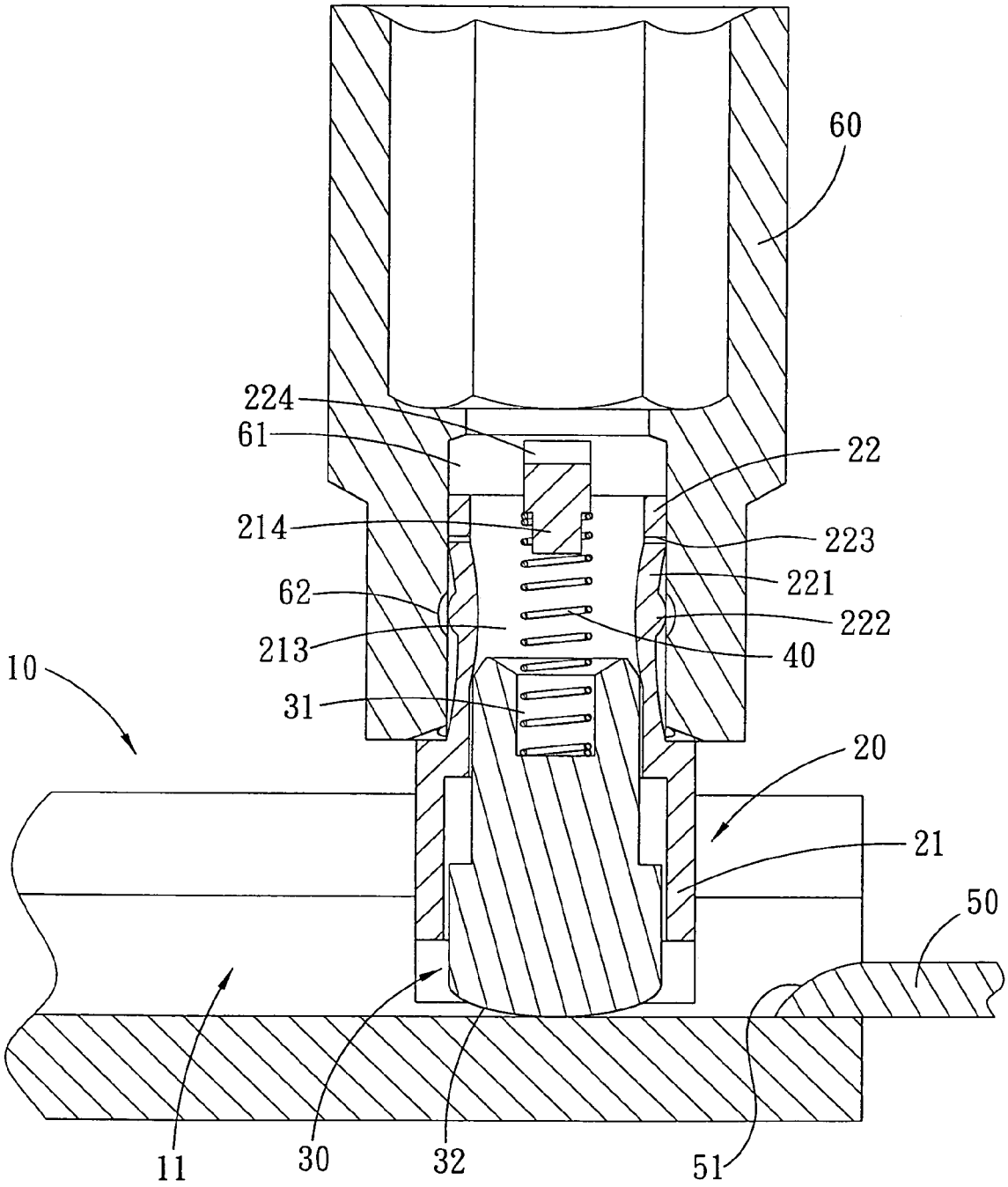
Figure 4:
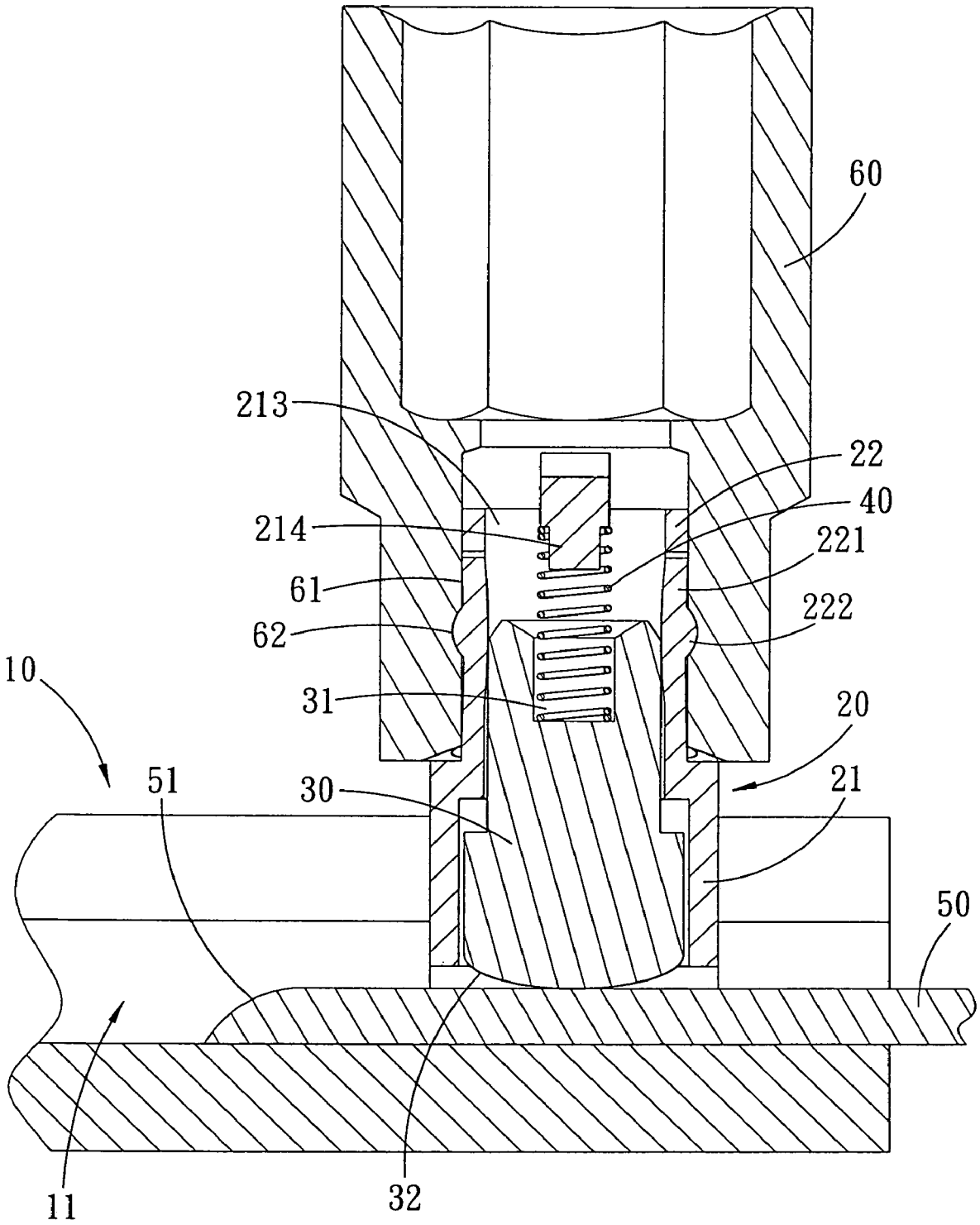

To enable the socket to be positioned in an anti-theft manner, with reference to FIGS. 3 and 4, the user can initially engage the engaging hole 61 of the socket 60 with the head 22 of the retainer 20, and then inserts the end of the positioning member 50 having the arc-shaped surface 51 between the sliding groove 11 of the housing 10 and the bottom of the housing 21 of the retainer 20.

During insertion of the positioning member 50, the arc-shaped surface of the positioning member 50 will push the pushing head 32 to make the inserting member 30 move upward until the positioning member 50 fully inserts between the sliding groove 11 of the housing 10 and the bottom of the housing 21 of the retainer 20. Furthermore, during the movement of the inserting member 30 within the recess 213, the end of the inserting member 30 having the cavity 31 will compress the elastic member 40 toward the projection 214 of the retainer 20.

During the movement of the inserting member 30, the circumferential surface of the inserting member 30 will push against the inner side of the bent locking portion 221 of the retainer 20, so that the bent locking portion 221 will be deformed to make the projection 222 engage in the cavity 62 of the socket 60. Therefore, the socket 60 is positioned in an antitheft manner, and the display device for socket in accordance with the present invention processes an antitheft function.

To turn off the antitheft function, namely to release the socket from the display device, the user only needs to pull the positioning member 50 backward from the space between the sliding groove 11 of the housing 10 and the bottom of the housing 21 of the retainer 20, and then the elastic member 40 push the inserting member 30 back to its original position. After the inserting member 30 moves back to its original position, the bent locking portion 221 will return to its original position due to its elastic characteristic, so that the projection 222 of the bent locking portion 221 will disengage from the cavity 62 of the socket 60, and thus the socket 60 can be released from the display device (the antitheft function is turned off).

It can be concluded from the above descriptions that the socket 60 can be released or locked simply through insertion and withdrawal of the positioning member 50, this allows the user to release the socket 60 from the display device, or to position the socket 60 again on the display device and turn on the antitheft function after use. Therefore, the display device for socket in accordance with the present invention not only possesses antitheft function but also can be used repeatedly.

The engagement of the ribs 13 with the cavities 14 allows the housings 10 to be connected together, so that the number of the housings 10 connected can be controlled arbitrarily according to needs.

Figure 5:
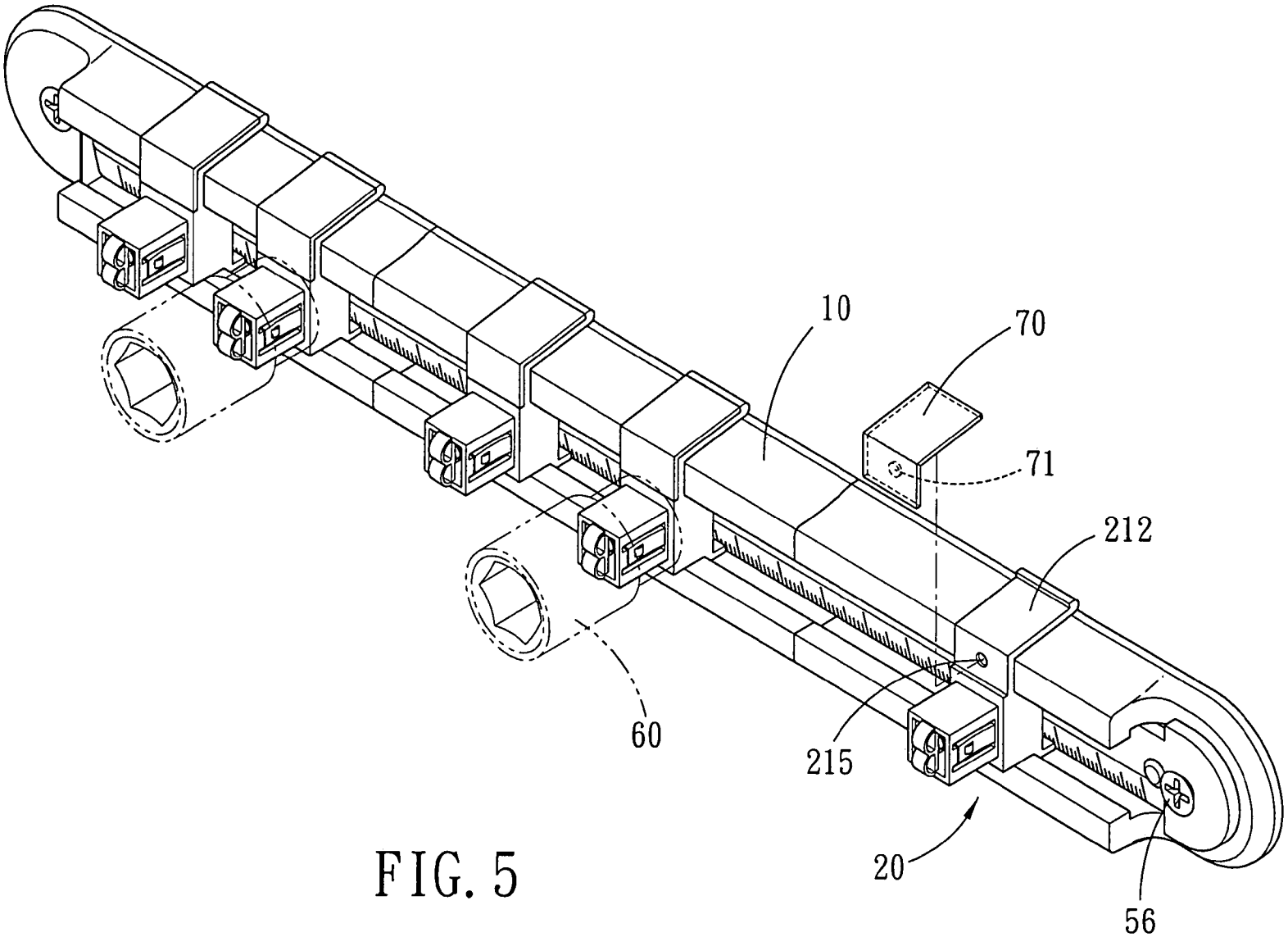
FIG. 5 is an exploded view of a part of an antitheft display device for socket in accordance with a second preferred embodiment of the present invention.

Referring to FIG. 5, an antitheft display device for socket in accordance with a second preferred embodiment of the present invention is similar with that of the first embodiment, except that:

To the bend portion 212 of the retainer 20 is attached a label board 70, on the bend portion 212 is formed a locking cavity 215, while the label board 70 is correspondingly provided with a locking pin 71 which is to be inserted in the locking cavity 215, so as to attach the label board 70 to the bend portion 212 of the retainer 20. The label board 70 is to be printed with trademark, dimension of the socket to be hung, and other useful information.

In addition, the display device for socket of the present invention can be hung to the wall of shop, workshop, surface of desk, and other surfaces, by screwing screw 56 into the through hole 54 of the positioning member 50 and the hanging hole 17 of the housing 10.

Figure 6:
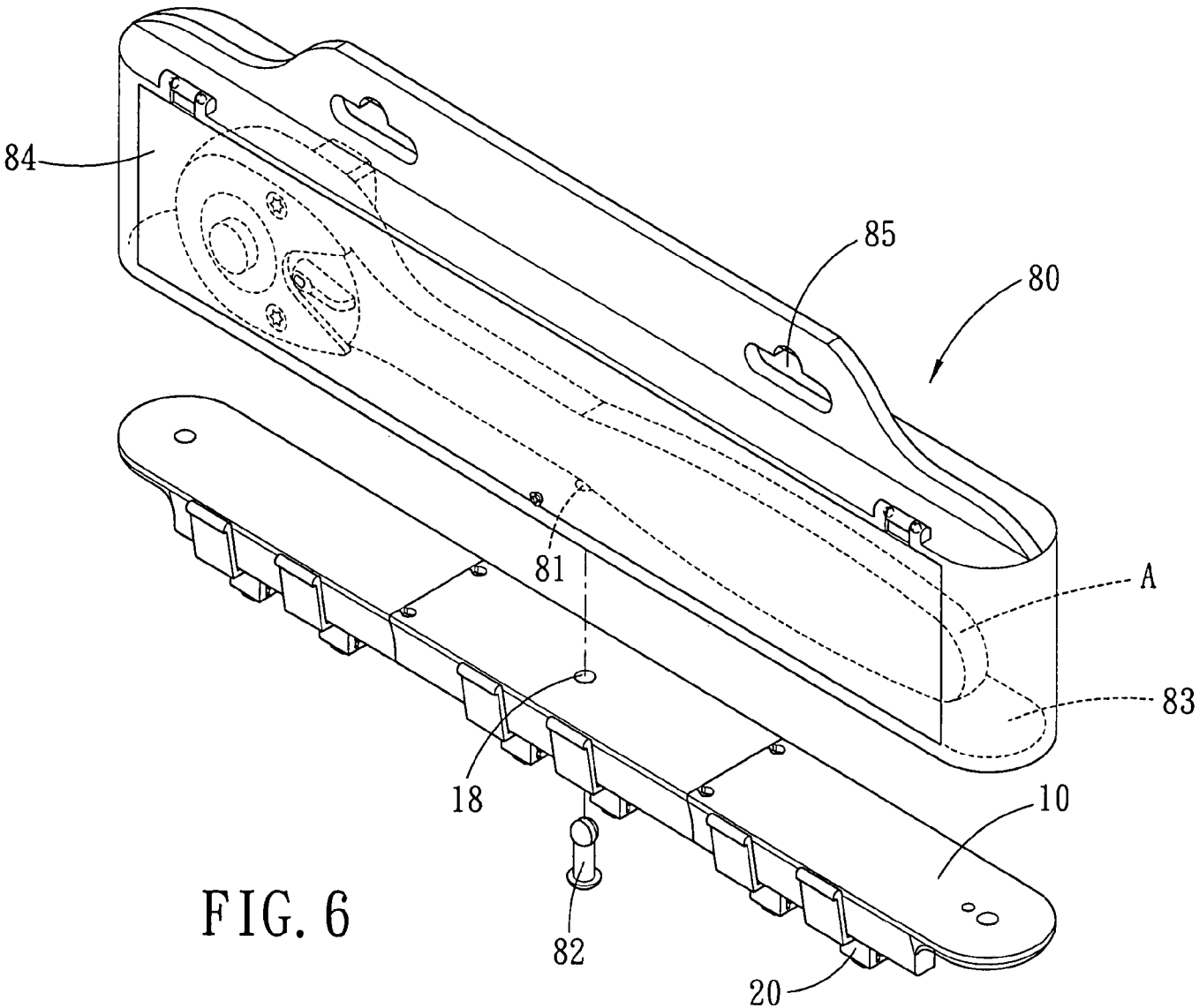
FIG. 6 is an exploded view of a part of an antitheft display device for socket in accordance with a third preferred embodiment of the present invention.
Figure 7:
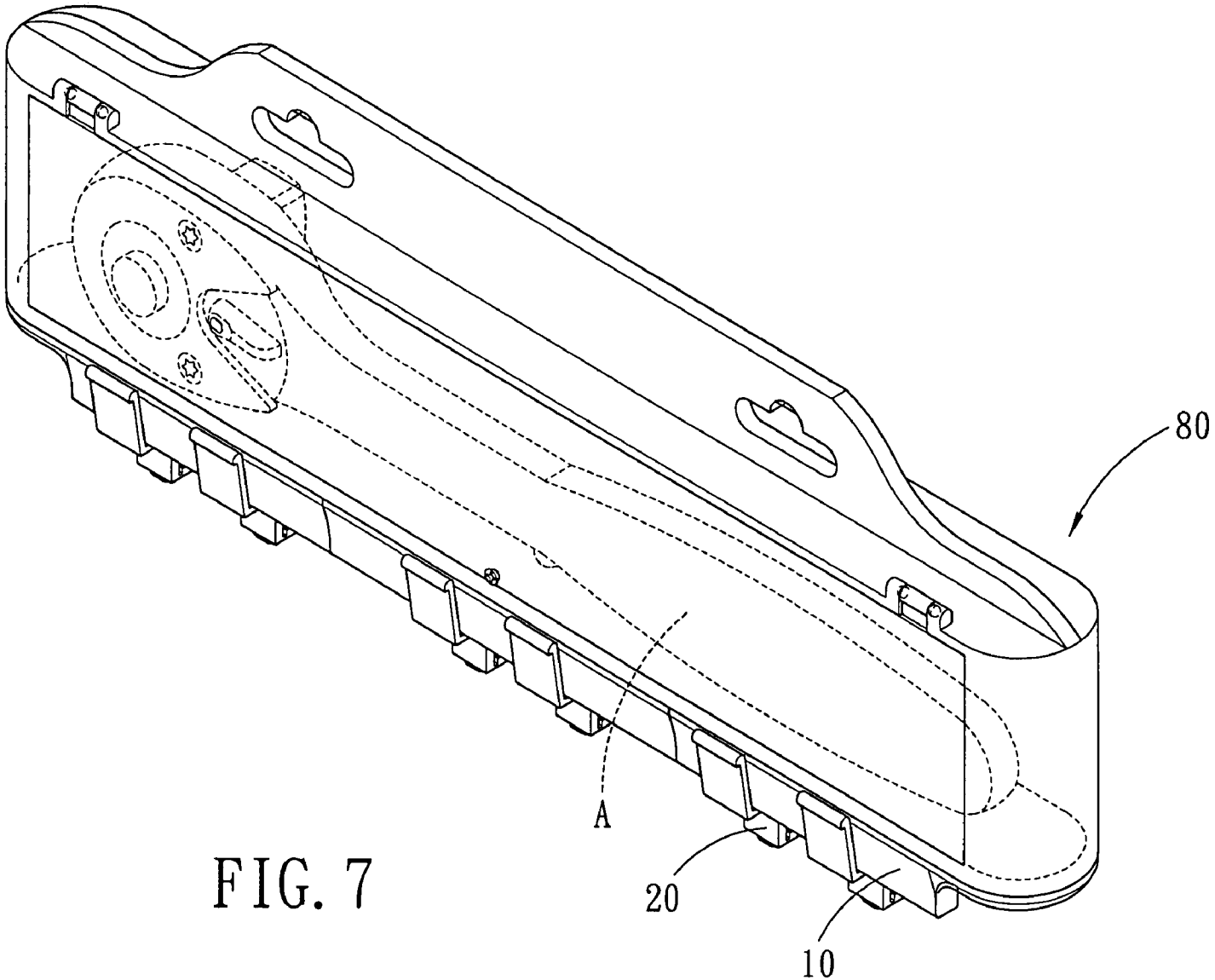
FIG. 7 is a perspective view of an antitheft display device for socket in accordance with the third preferred embodiment of the present invention.

Referring to FIGS. 6 and 7, an antitheft display device for socket in accordance with a third preferred embodiment of the present invention is similar with that of the first embodiment, except that:

A container 80 is fixed to the housing 10, on the bottom of the housing 10 is formed a connecting hole 18, and the container 80 is correspondingly provided with a fixing hole 81, and then a connecting pin 82 is inserted in the fixing hole 81 and the connecting hole 18 to fix the container 80 to the housing 10 (the connecting pin 82 can be replaced by screws).

The container 80 is interiorly provided with a chamber 83 for accommodation of a ratchet spanner A, an opening of the container 80 is fully covered by a cover 84, and above the container 80 is formed a hanging hole 85.

Figure 8:
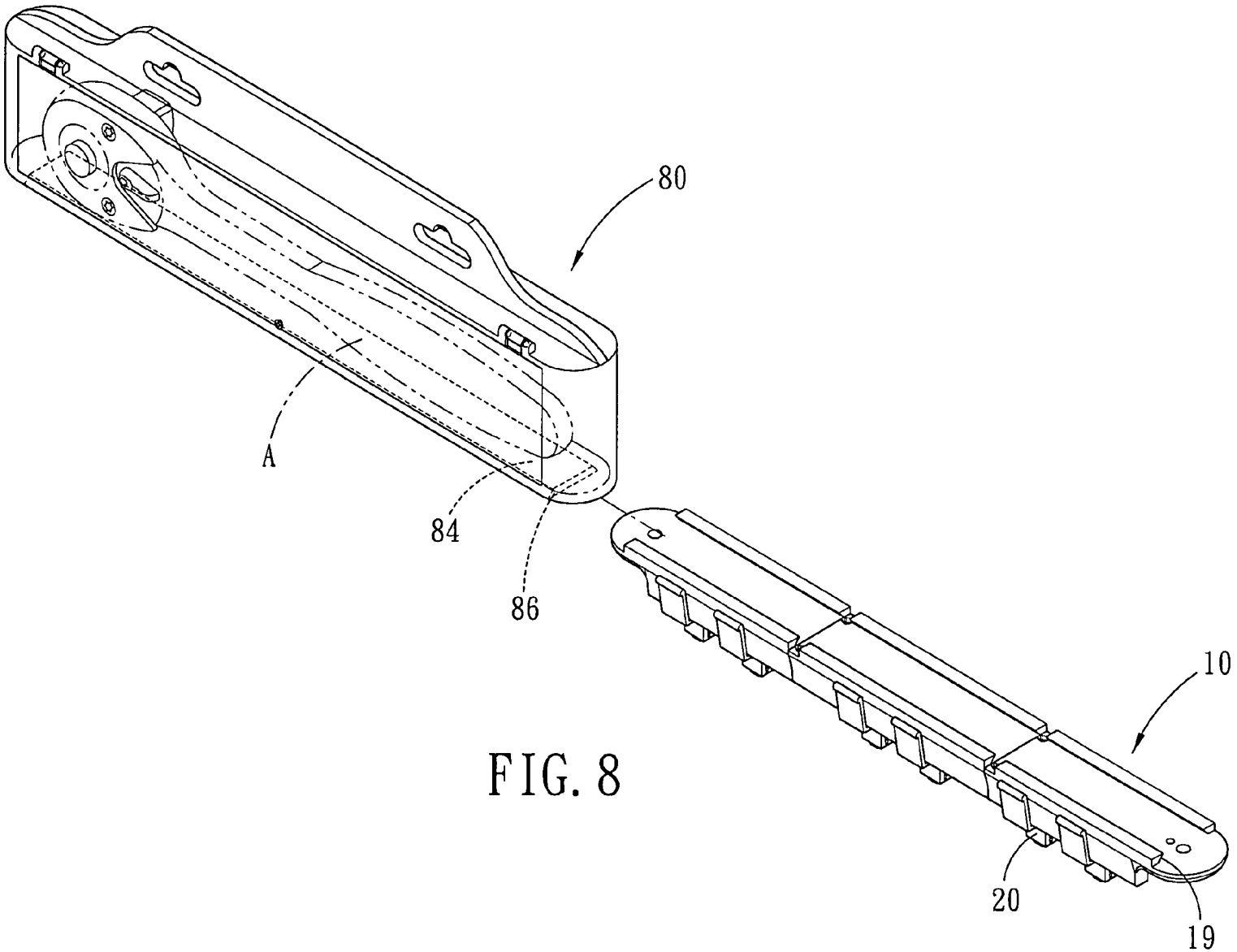
FIG. 8 is an exploded view of a part of an antitheft display device for socket in accordance with a fourth preferred embodiment of the present invention.

Referring to FIG. 8, an antitheft display device for socket in accordance with a fourth preferred embodiment of the present invention is similar with that of the third embodiment, except that:

At the bottom of the housing 10 is formed a sliding groove 19 which is dovetail-shaped in cross section, the container 80 is provided with a rail 86 formed correspondingly to the sliding groove 19, so that the container 80 is assembled to the housing through the engagement of the rail 86 with the sliding groove 19.

Figure 9:
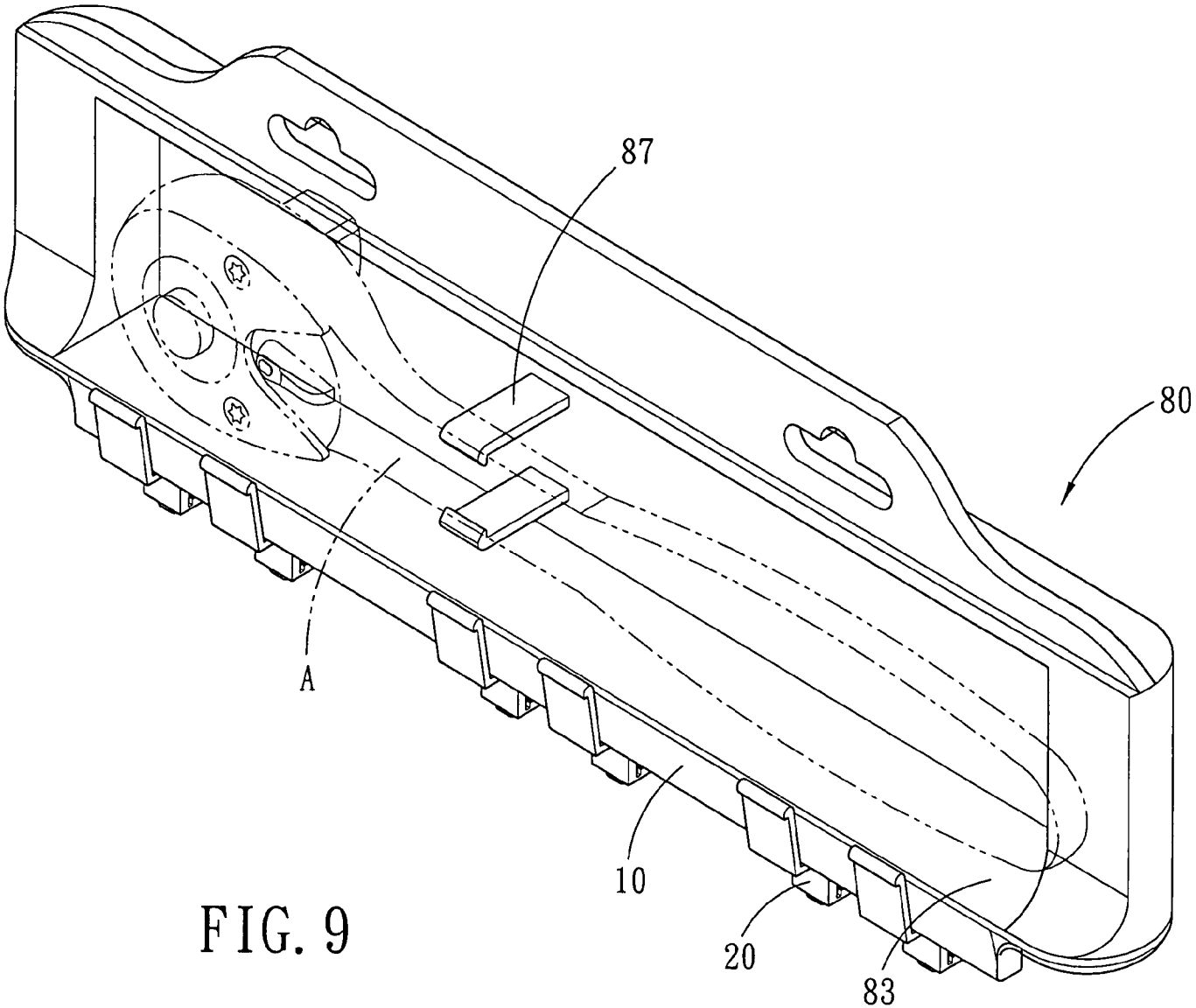
FIG. 9 is a perspective view of an antitheft display device for socket in accordance with a fifth preferred embodiment of the present invention.

Referring to FIG. 9, an antitheft display device for socket in accordance with a fifth preferred embodiment of the present invention is similar with that of the third, fourth embodiments, except that:

The container 80 is integrally formed with the bottom of the housing 10 and is provided with an open chamber 83 in which are formed two opposite parallel clamping plates 87, and the ratchet wrench A can be positioned between the clamping plates 87 firmly.

While we have shown and described various embodiments in accordance with the present invention, it should be clear to those skilled in the art that further embodiments may be made without departing from the scope of the present invention.

What is claimed is:

1. An antitheft display device for socket comprising:

a housing formed with an axial sliding groove, a guiding groove formed in either side of the sliding groove;

a retainer including a base integrally formed with a head, wherein a recess is formed in a bottom of the base, and formed in the recess is a projection, the base is provided with rails to be slideably received in the guiding groove of the housing, the head is provided for engagement with a socket, an elastic bent locking portion is formed at either side of the head, a plurality of arc-shaped projections is formed on the bent locking portion for engaging with cavities of the socket, a slit is formed in a lateral edge of the bent locking portion;

an inserting member moveably inserted in the recess of the retainer, a cavity for engaging with the projection of the retainer is formed in an end of the inserting member, and another end of the inserting member is formed with a pushing head;

an elastic member biased between the cavity of the inserting member and the projection of the retainer;

a positioning member inserted in a space between the sliding groove of the housing and the pushing head of the inserting member;

by pushing the inserting member with the positioning member, the inserting member will be forced to move within the recess and to compress the elastic member, and meanwhile, circumferential surface of the inserting member will press down the bent locking portion of the retainer, thus enabling the projections of the bent locking portion to be retained in the cavities of the socket.

2. The antitheft display device for socket as claimed in claim 1, wherein a hanging portion is formed at an end of the housing, and a hanging hole is formed in the hanging portion.

3. The antitheft display device for socket as claimed in claim 2, wherein a through hole is formed on the hanging portion of the housing, and formed at an end of the positioning member is a handle portion having a semi-circle shape, the handle portion is formed with a hole, and a locking pin is inserted through the hole of the handle portion into the through hole of the hanging portion of the housing.

4. The antitheft display device for socket as claimed in claim 3, wherein a container is integrally formed with the housing.

5. The antitheft display device for socket as claimed in claim 3, wherein a container is assembled to the housing by screws.

6. The antitheft display device for socket as claimed in claim 3, wherein a container is assembled to the housing by locking pins.

7. The antitheft display device for socket as claimed in claim 3, wherein a sliding groove in formed at a bottom of the housing, the container is provided with a rail to be slideably inserted in the sliding groove.

8. The antitheft display device for socket as claimed in claim 1, wherein a bent portion is formed at a side of the base and straddles over the housings, on the bent portion is disposed a label board.

9. The antitheft display device for socket as claimed in claim 8, wherein a locking cavity is formed on a bend portion of the retainer, the label board is correspondingly provided with a locking pin that is to be inserted in the locking cavity.

10. The antitheft display device for socket as claimed in claim 1, wherein the pushing head of the inserting member is arc-shaped.

11. The antitheft display device for socket as claimed in claim 1, wherein an arc-shaped surface is formed at an end of the positioning member for guiding the positioning member to be inserted in a space between the sliding groove of the housing and the pushing head of the inserting member.

12. The antitheft display device for socket as claimed in claim 1, wherein the positioning member is marked with scales for measuring purpose.

13. The antitheft display device for socket as claimed in claim 1, wherein a container for storing ratchet wrench is disposed at a bottom of the housing.

14. An antitheft display device for socket comprising:

a plurality of housings, each of which being formed with an axial sliding groove, wherein a guiding groove formed in either side of the sliding groove, a plurality of ribs is formed at an end of the housings, each of the ribs includes a circular base portion and a neck portion, and a plurality of cavities is formed in another end of each of the housings and is formed correspondingly to the shape of the ribs, so that the plurality of housings are connected to one another through engagement of the ribs with the cavities;

a retainer including a base integrally formed with a head, wherein a recess is formed in a bottom of the base, and formed in the recess is a projection, the base is provided with rails to be slideably received in the guiding groove of the housings, the head is provided for engagement with a socket, an elastic bent locking portion is formed at either side of the head, a plurality of arc-shaped projections is formed on the bent locking portion for engaging with cavities of the socket, a slit is formed in a lateral edge of the bent locking portion;

an inserting member moveably inserted in the recess of the retainer, a cavity for engaging with the projection of the retainer is formed in an end of the inserting member, and another end of the inserting member is formed with a pushing head;

an elastic member biased between the cavity of the inserting member and the projection of the retainer;

a positioning member inserted in a space between the sliding groove of the housing and the pushing head of the inserting member;

by pushing the inserting member with the positioning member, the inserting member will be forced to move within the recess and to compress the elastic member, and meanwhile, circumferential surface of the inserting member will press down the bent locking portion of the retainer, thus enabling the projections of the bent locking portion to be retained in the cavities of the socket.

15. The antitheft display device for socket as claimed in claim 14, wherein a bent portion is formed at a side of the base and straddles over the housings, and on the bent portion is a label board.

16. The antitheft display device for socket as claimed in claim 14, wherein an arc-shaped surface is formed at an end of the positioning member for guiding the positioning member to be inserted in a space between the sliding groove of the housing and the pushing head of the inserting member.

17. The antitheft display device for socket as claimed in claim 14, wherein a container for storing ratchet wrench is disposed at a bottom of the housing.

18. The antitheft display device for socket as claimed in claim 17, wherein the container is assembled to the housing by screws.

19. The antitheft display device for socket as claimed in claim 17, wherein a sliding groove is formed in a bottom of the housing, the container is provided with a rail to be slideably inserted in the sliding groove.

20. The antitheft display device for socket as claimed in claim 14, wherein a through hole is formed on the hanging portion of the housing, and formed at an end of the positioning member is a handle portion having a semi-circle shape, the handle portion is formed with a hole, and a locking pin is inserted through the hole of the handle portion into the through hole of the hanging portion of the housing.

* * * * *